US005297986A

United States Patent [19]

Ristvedt et al.

[11] Patent Number: 5,297,986

[45] Date of Patent: * Mar. 29, 1994

[54] COIN SORTING APPARATUS WITH ROTATING DISC

[75] Inventors: Victor G. Ristvedt; Mark E. Ristvedt, both of Manchester, Tenn.

[73] Assignee: Cummins-Allison Corp., Mt. Prospect, Ill.

[ * ] Notice: The portion of the term of this patent subsequent to Jan. 5, 2010 has been disclaimed.

[21] Appl. No.: 976,144

[22] Filed: Nov. 10, 1992

Related U.S. Application Data

[63] Continuation of Ser. No. 514,299, Apr. 26, 1990, Pat. No. 5,176,565, which is a continuation of Ser. No. 79,683, Jul. 30, 1987, Pat. No. 4,966,570.

[51] Int. Cl.[5] ..... G07D 3/16

[52] U.S. Cl. ..... 453/6; 453/32

[58] Field of Search ..... 453/6, 10, 32

[56] References Cited

U.S. PATENT DOCUMENTS

| | | | |
|---|---|---|---|
| 4,086,928 | 5/1978 | Ristvedt . | |
| 4,098,280 | 6/1978 | Ristvedt . | |
| 4,506,685 | 3/1985 | Childers et al. . | |
| 4,543,969 | 10/1985 | Rasmussen | 453/10 |
| 4,549,561 | 10/1985 | Johnson et al. . | |
| 4,557,282 | 12/1985 | Childers et al. | 453/6 |
| 4,564,036 | 1/1986 | Ristvedt . | |
| 4,564,037 | 1/1986 | Childers et al. . | |
| 4,570,655 | 2/1986 | Raterman . | |
| 4,607,649 | 8/1986 | Taiple et al. . | |
| 4,681,128 | 7/1987 | Ristvedt et al. | 453/6 |
| 4,731,043 | 3/1988 | Ristvedt . | |
| 4,775,353 | 10/1988 | Childers et al. . | |
| 4,775,354 | 10/1988 | Rasmussen | 453/10 |
| 4,863,414 | 9/1989 | Ristvedt et al. | 453/6 |
| 4,921,463 | 5/1990 | Primdahl et al. . | |
| 4,966,570 | 10/1990 | Ristvedt et al. . | |
| 5,009,627 | 4/1991 | Rasmussen . | |
| 5,011,455 | 4/1991 | Rasmussen . | |
| 5,026,320 | 6/1991 | Rasmussen . | |

*Primary Examiner*—F. J. Bartuska
*Attorney, Agent, or Firm*—Arnold, White & Durkee

[57] ABSTRACT

A coin sorting apparatus receives coins through an opening in a guide plate onto the resilient surface of a rotating disc. The surface of the guide plate is contoured and includes portions positioned sufficiently close to the surface of the disc to press coins traveling therebetween into the resilient surface of the disc. As the coins are circulated circumferentially between the discs, the countours in the guide plate guide the coin into a single file along a first prescribed path. Coins of at least one selected denomination are displaced to follow a second prescribed path. The coins are discharged along each described path at exit locations at the periphery of the plate.

46 Claims, 4 Drawing Sheets

COIN SORTING APPARATUS WITH ROTATING DISC

RELATED CROSS-REFERENCE

This application is a continuation of application Ser. No. 07/514,299 filed Apr. 26, 1990 now U.S. Pat. No. 5,176,565, which is a continuation of Ser. No. 07/079,683 filed Jul. 30, 1987 now U.S. Pat. No. 4,966,570 issued Oct. 30, 1990.

FIELD OF THE INVENTION

This invention relates generally to coin handling equipment and particularly to coin sorting machines of the type that have a rotating disc with a resilient surface cooperating with a stationary sorting head or guide plate.

SUMMARY OF THE INVENTION

It is a primary object of the present invention to provide an improved coin sorting machine which is capable of sorting coins of any desired denomination(s) from a batch of coins containing any combination of denominations.

It is another important object of this invention to provide an improved coin sorting machine of the foregoing type which can be readily adjusted to change the desired coin denomination(s) to be sorted.

Still another object of this invention is to provide an improved coin sorting machine which is smaller than most other coin sorting machines.

Other objects and advantages of the invention will be apparent from the following detailed description and the accompanying drawings.

DESCRIPTION OF THE PREFERRED EMBODIMENT

Figure 1:
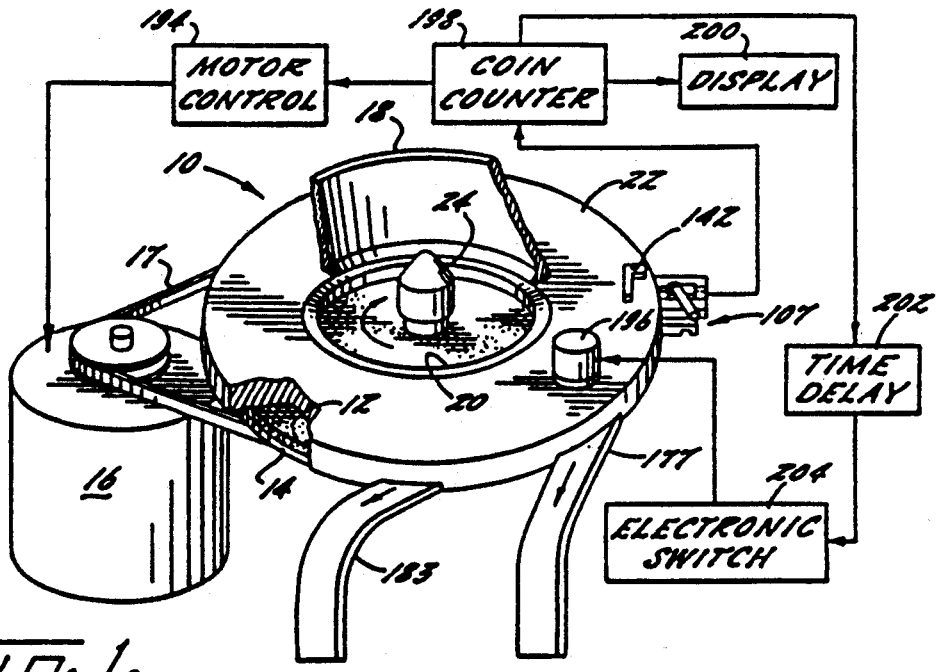
FIG. 1 is a perspective view of an exemplary embodiment of the invention with portions broken away to reveal the internal structure, and with the associated electrical control system illustrated in the form of a block diagram.

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents, and alternatives falling with the scope of the invention as defined by the appended claims.

Referring initially to FIG. 1, there is shown a coin sorter 10 having a resilient disc in the form of pad 12 of an elastomer construction rotated on and by a turntable 14 driven by a motor 16 via belt 17. A hopper 18 (partially broken away) is positioned about a central opening 20 in a stationary guide plate 22, and coins to be sorted are inserted through this hopper. The guide plate 22 is supported, by means not shown, at a selected spacing with respect to the pad 12, typically 0.005 to 0.010 inch. A centrally positioned hub 24 extends upwardly through an opening (not shown) in the pad 12 and is conventionally secured as by a threaded connection to the turntable 14 The hub 24 has a tapered surface which functions to direct coins in an off-center direction so that there will always be some centrifugal force tending to cause coins to move outwardly toward the inner periphery of the guide plate 22.

Figure 2:
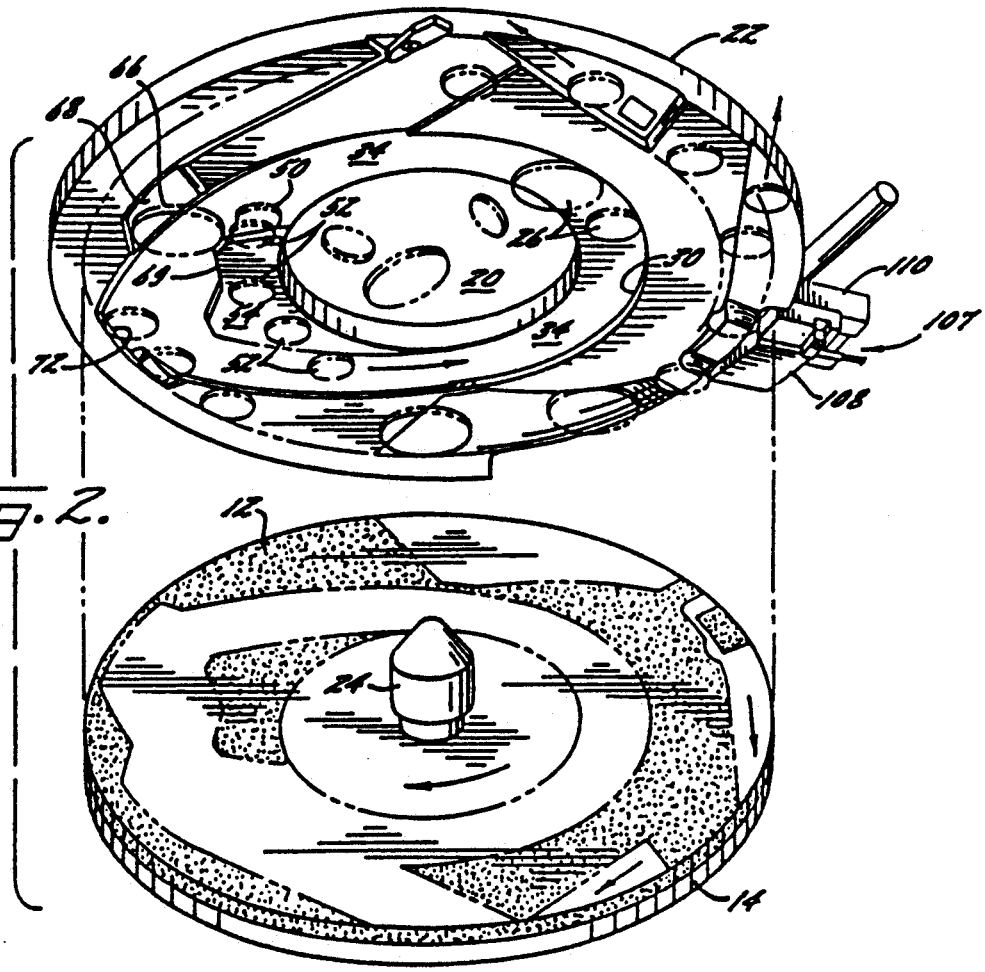
FIG. 2 is an enlarged, exploded perspective view of the rotatable disc and the stationary sorting head or guide plate in the machine of FIG. 1, with the configuration of the underside of the guide plate superimposed on the top surface of the rotatable disc.

Referring now additionally to FIGS. 2–18, the underside of the guide plate 22 is configured to guide coins rotated by the pad 12 (in the direction of the arrows in FIG. 2) in a circular and then spiral path within an inner recess 34 which overall is oval in configuration and forms a guide edge 30. The coins are moved, as illustrated by coins 26 in FIG. 2, outwardly by centrifugal force in a path governed by the tapered inner facing edge 30 of the recess 34. This recess 34 generally has a depth on the order of 0.005 to 0.010 inch deeper than the thickest coin to be sorted. Thus, the coins are free to move radially beneath the top surface of the recess 34. The first part of the coins' travel is generally circular from point 38 to point 40 (FIG. 3) and within that region most of the coins are formed in a single file.

At approximately point 42 (FIG. 3), the edge 30 of the central portion 35 of the recess 34 transitions, in a recess portion 44 (FIG.. 3), from being circular to a spiral, and thereafter coins are moved outwardly, along edge 43, by the combination of circular movement of the pad 12 and centrifugal force. The recess region 44 may be of the same depth or slightly shallower than other portions of the recess 34, the latter being the case where the thickness of the thickest coin to be sorted is greater than the thickness of two of the thinnest coins to be sorted. In all cases, the depth is preferably less than the thickness of the two thinnest coins to be sorted, typically 0.010 to 0.020 inch less in depth. Where it is necessary to provide reduced depth, there is preferably a gradual transition or slight ramp downwardly between central portion 35 of the recess 34 and the recess region 44 and downwardly between the recess region 44 and a region 67. This dimension in the recess portion 44 is required in order to separate two thin coins, such as illustrated by coins 50 and 52 in FIG. 2) when they have assumed a position where one coin is on top of the other, as shown.

Separation is effected by a guide 54 (FIGS. 2 and 3) as follows. With the depth of recess region 44 less than the thickness of the two piggyback coins 50 and 52, the bottom coin 52 is frictionally engaged by the pad 12 (FIG. 1) and moved beneath the guide 54 in a generally circular path as depicted by the dashed line positions of this coin in FIG. 2. Thereafter, the coin moves back into the recess 34. Finally, the coin is free of compression in recess 34, enabling it to be simply recirculated around on the pad 12. Meanwhile, the upper coin 50 is restrained by an upper flat portion 63 (FIG. 8) of the leading edge 58 of the guide 54, and this coin passes outboard of the guide 54. The guide 54 fully tapers at the point 40 from the recess region 44 to the lowermost surface of the guide 54 so that a coin striking this point simply rides over the guide 54 and is recirculated.

Figure 8:
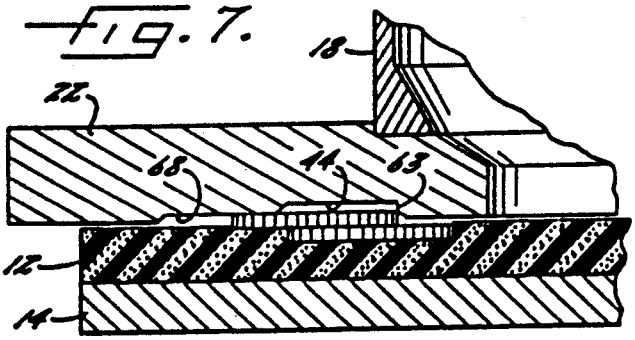
FIG. 8 is a section taken generally along line 8—8 in FIG. 3.
Figure 9:
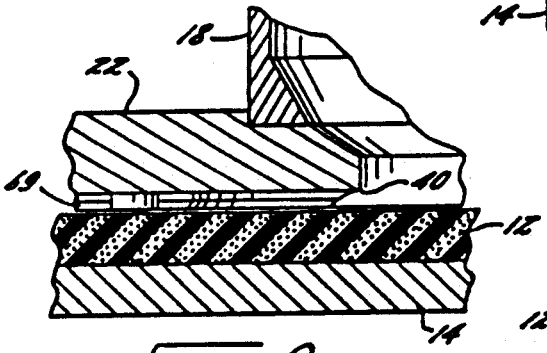
FIG. 9 is a section taken generally along line 9—9 in FIG. 3.
Figure 10:
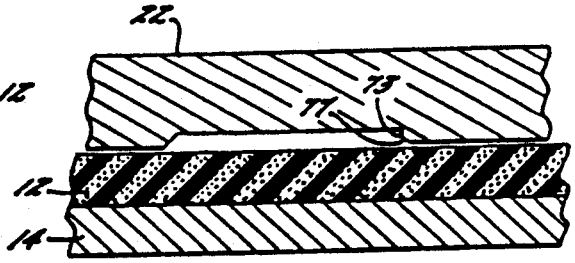
FIG. 10 is an enlarged section taken generally along line 10—10 in FIG. 3.

The recess region 44 also forms a restricted passageway for a single file of small coins, for example, pennies and dimes of U.S. coinage. This passageway is formed between an outward projection 62 of the guide 54 and the outer edge 64 of the recess region 44. The edge 30 and its extension 64 are both tapered as shown in FIG. 8, this taper effecting a wedging action of coins to prevent bounce.

Larger coins (e.g., a nickel, quarter, Susan B. Anthony dollar, or half dollar of U.S. coinage), such as illustrated by the coin 66 in FIGS. 2 and 3, actually cartwheel outwardly into a recessed area 68 and thereby move around the projection 62 until they are moved circularly beyond the recess region of recess 34 where they are free to move outwardly by centrifugal force. The recessed area 68 is of less depth than the recess region 44. As a result, the larger coins are actually captured by the pad 12 and rotated by it. The outer edge region 69 of the guide 54 lies generally in a fixed radial configuration in order to enable a sufficiently large area of the recess region 44 to accommodate free movement of coins by centrifugal force. As a result, the larger coins, and, of course, the smaller ones also, move along the spiraling edge 42 to a generally circular edge 72, as illustrated by the coin 71.

In the event that a coin is, for some reason, on top of another coin within the area 67 of the recess 34, an edge 78 of the guide 54, having an upper straight edge region 73 and a lower tapered edge 77 (FIG. 10), will effect a separation of the coins, causing the lower of the coins to be moved over the guide 54 as described for the separation and movement of coins 50 and 52. The edge 78 thus breaks up any jams that may form between coins, as by doubling, and captures any coins moved against edge 78 and causes them to be recirculated back into the recess 34 for reforming in a single file.

Figure 3:
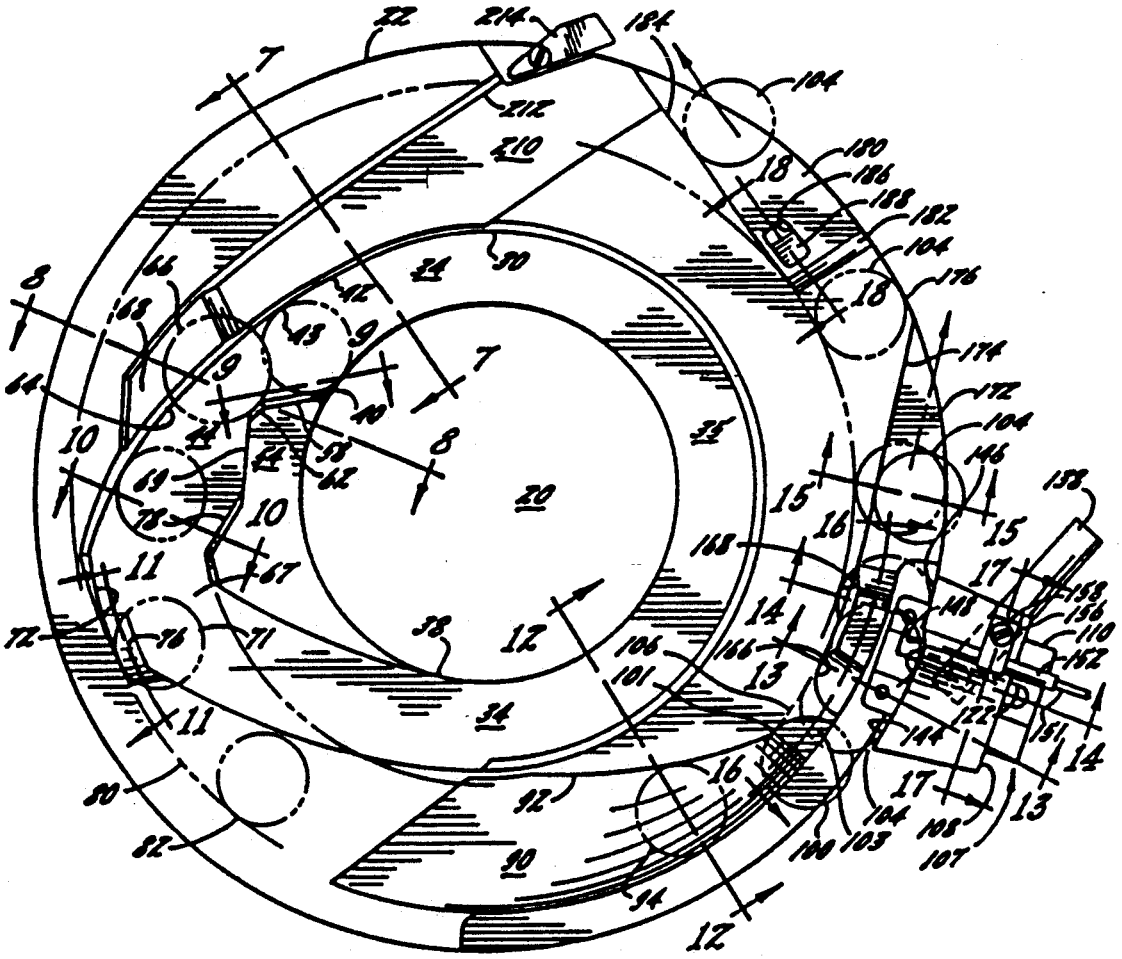
FIG. 3 is a further enlarged plan view of the sorting head or guide plate in the machine of FIG. 1.
Figure 11:
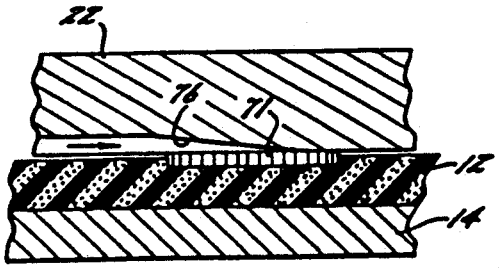
FIG. 11 is an enlarged section taken generally along line 11—11 in FIG. 3.

Freely moving coins finally form in a single file and are rotated by pad 12 to a position where they engage a downwardly extending ramp 76, as illustrated by the coin 71 in FIGS. 3 and 11. The ramp 76 effects a depression of the coins into the pad 12, so that the coins are captured at their then radial position. The dashed line 80 in FIG. 3 indicates a maximum diameter circular path along which the captured coins may progress, as shown by coin 82. This path may be inward somewhat depending upon where the coins are captured by ramp 76.

Figure 12:
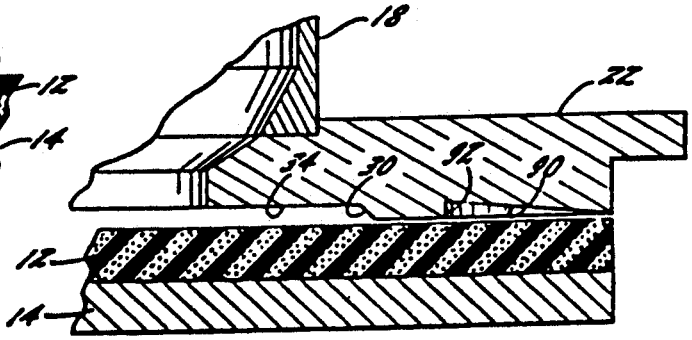
FIG. 12 is an enlarged section taken generally along line 12—12 in FIG. 3.

Coins are next rotated into a tapered recess 90, the contour of which is illustrated in FIG. 12. Most significantly, the recess 90 is tapered upwardly and inwardly and includes an outwardly curving coin positioning edge 92. A coin 94 is shown in FIG. 3 as being within the recess 90 along the circular path of the dashed line 80 until this coin is rotated to a position where its inner edge engages the edge 92 of the recess 90. When this occurs, the coin is urged outwardly along the edge 92 to a point 101 where the edge 92 merges into ramp 103, as illustrated by coin 100 in FIG. 3. The ramp 103 is configured like the ramp 76 shown in FIG. 11 and functions to urge a coin downwardly, as would be the case for a coin 104. Thereafter, coins are rotated with their inner edges radially referenced to this point. The dashed line 106 in FIG. 3 illustrates this path of rotation, and coin 104 illustrates a coin following it. Significantly, this means that the outer edges of the coins traverse circular paths which are uniquely determined by their diameters. It follows that a circular path of the outer edge of a half dollar is at a larger radius of rotation than smaller diameter coins.

While operation of the illustrative device has generally been described above, it will be reviewed. First, coins of different diameters to be sorted are placed in the hopper 18, and thus deposited on the pad 12. When the motor 16 is started, the pad 12 rotates in the direction of the arrows in FIG. 2, and the coins are moved by centrifugal force outwardly and into the recess 34 where they form in a single file against the guide edge 30. They are then moved outwardly where any doubled small coins, e.g., dimes, are separated by capturing the lower one and moving it under the guide 54. Smaller denomination coins, such as dimes and pennies, pass outwardly of the guide 54 within recess region 44 between the guide 54 and the guide edge 64. Larger coins are enabled to pass by a reduced depth recessed area 68 within which the larger coins (e.g., coin 66) effectively cartwheel outwardly and are then rotated back into the full depth recess 67. Coins in the recess 67 freely move outwardly by centrifugal force as in the case of coin 71. In case there exist in this recess doubled coins, one coin on top of the other, the coins are separated by the edge 78, enabling the lower of the coins to pass under the edge 78.

A coin normally passing outwardly within the recess 67 is stopped by the edge 72 and rotated under the ramp 76 which effects a capturing of the coin, as in the case of coins 71 and 82. Coins so captured are rotated under a recessed area 90. This area 90 is of less depth than the recessed area 34, and thus coins continue to be captured but are readily susceptible to radial movement when engaged by the inner edge 92 of the recess 90. The edge 92 moves the coins outwardly until the inner edges of the coins reach the reference radius designated by the dashed line 106. At this point, the coins are depressed further downward by the ramp 103 and fully captured by the lower surface of the guide plate 22, as in the case of coin 104.

As the coins are rotated along the ramp 103, they approach a coin selector assembly 107 which includes a radially adjustable, generally rectangular ramp member 108 and a rigidly mounted base 110. The base 110 is fastened to the guide plate 22 by screws 112 and has two opposed and elongated key slots 114 and 116; slot 114 is formed in the upper surface 118 of the base 110, and slot 116 is formed in the lower surface 120 of the base 110. An elongated opening 122 is centrally positioned and extends lengthwise in the slots 114 and 116.

The top of the ramp member 108 forms a key 126 which is dimensioned to slidably engage the bottom slot 116 in the base 110. Centrally located and extending perpendicular to the surface 128 of the key 126 is a threaded shaft 130 which extends through the opening 122 in the base 110. A referencing key 132 having an opening 134 and a referencing edge 136 is dimensioned to slidably engage the upper slot 114 in the base 110 and is mounted in the slot 114 with the threaded shaft 130 extending through the opening 134 in the key 132. A clamping handle 138 having a threaded opening 140 is threaded onto the shaft 130 so that the keys 126 and 136 may be tightly clamped within the slots 114 and 116, thus clamping the ramp member 108 in a selected position. Rigidly mounted on the top surface 144 of the guide plate 22 is an L-shaped referencing member 142 which, in conjunction with the indexing edge 136 of the key 132, allows for the precise positioning of the ramp 108 to selectively separate a single denomination of coin from a mix of coins, as will be described in more detail below.

Figure 4:
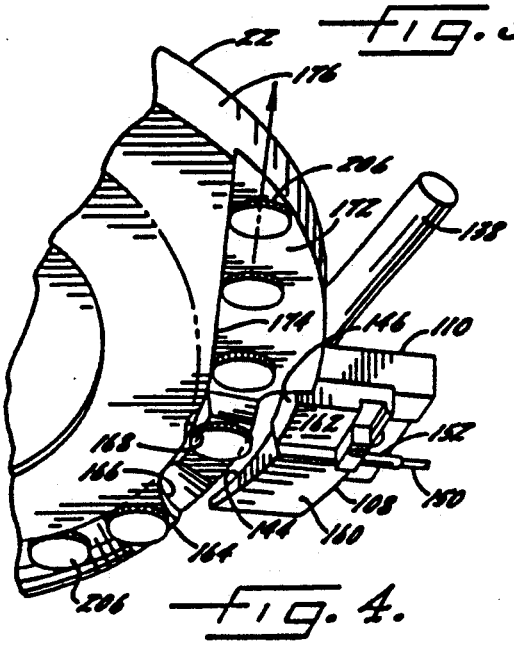
FIG. 4 is an enlarged perspective view of the right-hand portion of the sorting head as viewed in FIG. 3, illustrating the effect of the mechanism on coins of a first denomination having a relatively small diameter.
Figure 5:
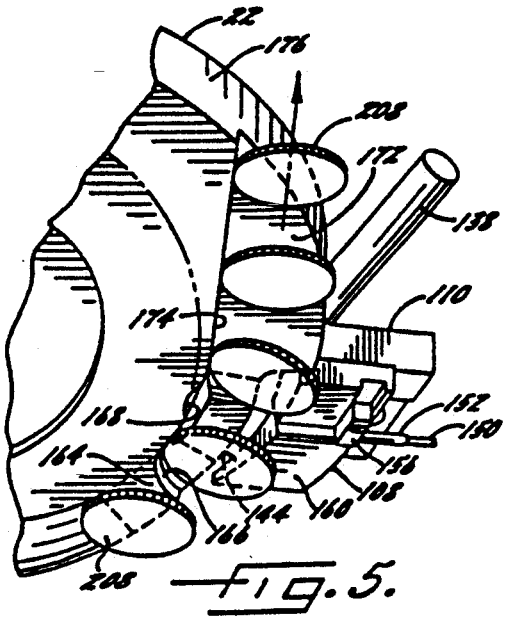
FIG. 5 is a perspective view of the same mechanism illustrated in FIG. 4, but showing the effect of the mechanism on coins of a second denomination having a relatively large diameter.
Figure 17:
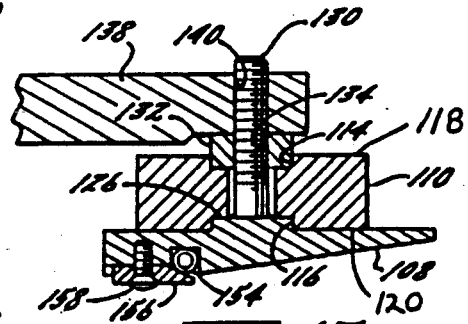
FIG. 17 is an enlarged section taken generally along line 17—17 in FIG. 3.

As can be seen in FIGS. 3-5, the inboard edge of the ramp member 108 forms two indexing surfaces 144 and 146 which are slightly offset from each other in the radial direction. Located between the two indexing surfaces 144 and 146 is a coin sorter probe 150 which is electrically insulated from the ramp 108 and thus the guide plate 22 by an insulating sleeve 152. The probe 150 is clamped into a slot 154 in the ramp member 108 by a clamp block 156 and screw 158 (FIG. 17). The inner end 148 of the probe 150 (FIGS. 3 and 14) is connected to a coin detecting and counting circuit, which will be further described below. As can be seen in FIGS. 4 and 5, a portion 160 of the lower surface of the ramp member 108 is inclined while another portion 162 is relatively flat.

Figure 18:
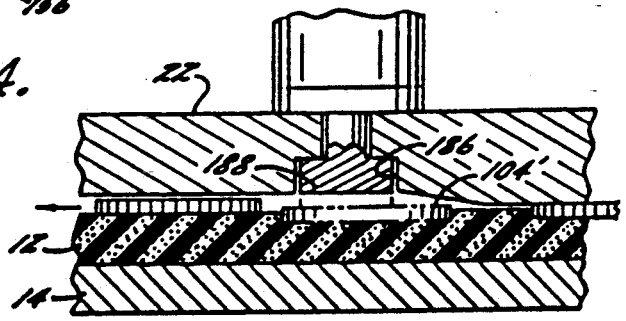
FIG. 18 is an enlarged section taken generally along line 18—18 in FIG. 3.
Figure 16:
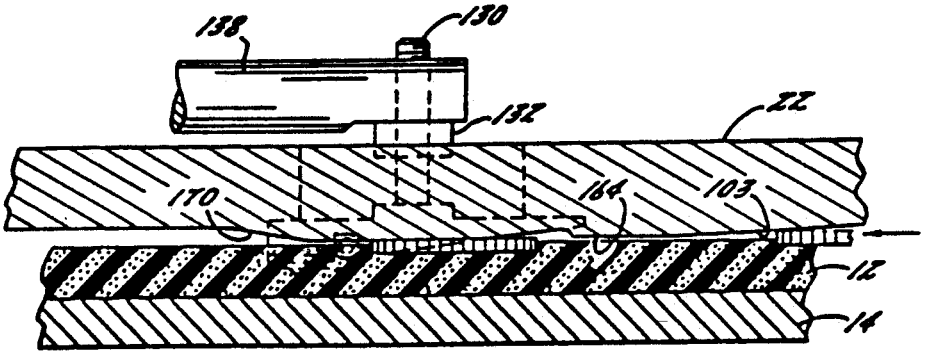
FIG. 16 is an enlarged section taken generally along line 16—16 in FIG. 3.

In the area adjacent the ramp member 108, the guide plate 22 is contoured (see FIG. 16) to work in conjunction with the ramp member 108 to effect the separation of a chosen denomination of coins. More specifically, the downwardly extending ramp 103 terminates in a capture area 164 which has a radially inwardly extending inner edge 166 including an override notch 168 within the edge 166. The capture area 164 leads to an upwardly extending ramp 170 which leads to an exit recess 172 forming an inboard guide wall 174. The guide wall 174 extends outwardly to the edge 176 of the guide plate 22 and functions to guide coins of undesired denominations out from under the guide plate 22 to a chute 177 (FIG. 1) leading to a bag or other coin receptacle. Conversely, the override notch 168 allows coins of the desired denomination to override the edge 166, become captured by the pad 12, and be rotated at a fixed radial position against the lowermost surface 178 of the guide plate 22 toward a second exit recess 180. The exit recess 180 has an inlet ramp 182 and an inboard guide wall 184 which extends outwardly to the outer periphery 176 of the guide plate 22 and functions to guide coins out from under the plate 22 to a chute 183. To stop the flow of coins along the exit recess 180, as when a predetermined number of coins have been discharged, an opening 186 (FIG. 18) is provided in recess 180 and contains a solenoid-operated stop shoe 188. The shoe 188 is normally retracted, as shown in FIG. 18, allowing coins to traverse the guide edge 184.

Figure 6:
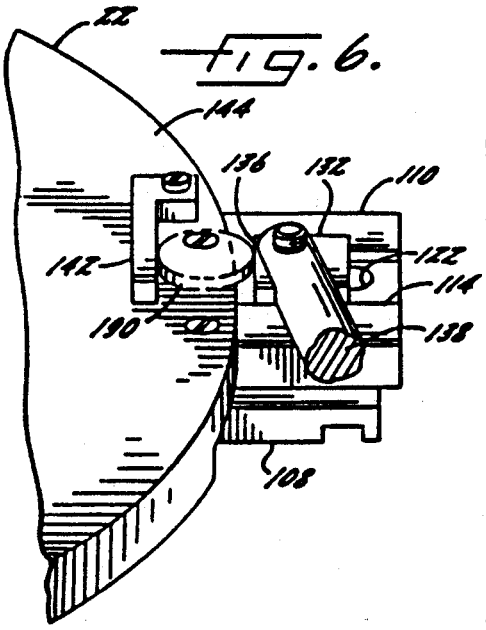
FIG. 6 is a perspective view of the top of the same portion of the sorting head shown in FIGS. 4 and 5.
Figure 7:
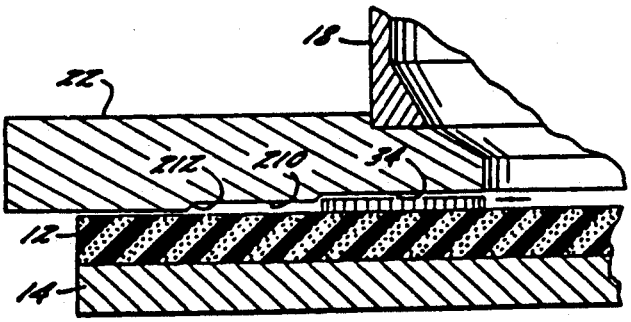
FIG. 7 is a section taken generally along line 7—7 in FIG. 3.
Figure 13:
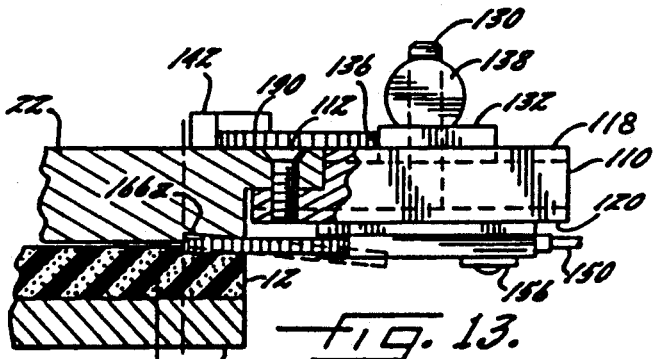
FIG. 13 is an enlarged section taken generally along line 13—13 in FIG. 3.
Figure 14:
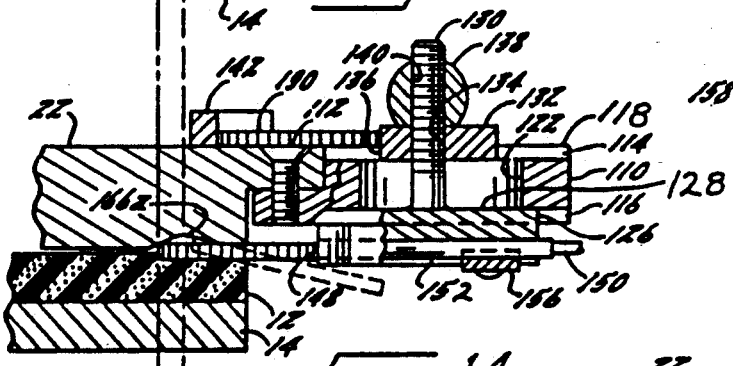
FIG. 14 is an enlarged section taken generally along line 14—14 in FIG. 3.
Figure 15:
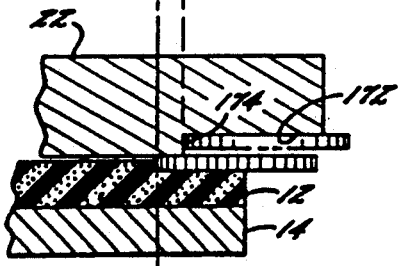
FIG. 15 is an enlarged section taken generally along line 15—15 in FIG. 3.

The coin selector assembly 107 is set to sort a particular denomination of coin, as shown in FIGS. 6, 13 and 14, by placing a coin 190 of the desired denomination between the referencing member 142 and the referencing edge 136 of the key 132. The ramp member 108 is then pushed to the left (as viewed in FIG. 6) so that the coin 190 is firmly clamped between the member 142 and the referencing edge 136 of the key 132, and the handle 138 is rotated to clamp the ramp member 108 in that position. This causes the probe end 148 and the indexing edge 146 of the ramp 108 to be positioned at a distance opposite the notch 168 which is slightly less than the diameter of the referenced coin. Consequently, coins of the selected diameter (denomination) strike the probe end 148 and are moved inwardly into the notch 168, thereby causing those coins to be captured by pressing their inboard edges into the pad 12, inboard of the guide edge 174 of the first exit recess 172. Thus, coins of the selected denomination are reindexed along their outboard edges by the probe tip 148 and the edge 146 of the ramp 108. Coins of other denominations do not touch the probe end 148 or edge 146, as will be explained below.

Referring now to FIG. 1, a control circuit is shown which allows a selected number of coins of a selected denomination to be ejected from the sorter 10 and guided by the chute 183 into an appropriate receptacle. This is accomplished by a motor control 194 and a delayed stop solenoid 196 for the stop shoe 188, both of which are activated by a signal from a coin detector and counter 198. A display 200 provides a visual readout from the counter 198. During operation, coins of the selected denomination are detected and counted as they strike the probe 148 until a prescribed count is reached, whereupon an activating signal is sent to the motor control 194 and a time delay circuit 202. The motor control 194 in turn applies a braking current to motor 16, rapidly braking the motor 16 and thus the turntable 14 and the pad 12 to a stop. As motor 16 cannot be stopped instantaneously, a time delay circuit 202 provides a delay of 0.1 to 0.2 seconds before energizing an electronic switch 204 and the relay 196. This delay allows the last counted coin to clear the sorter 10 before the solenoid 196 is energized to advance the stop shoe 188 and thereby recycle coins.

FIG. 4 shows the sequential positions of a coin 206 which is smaller than the selected coin engaged by the probe tip 148. As stated earlier, all coins are initially captured by the pad 12 and held with their inboard edges at the radius of point 100. Then, as the coin 206 rides under the ramp 102, it is pressed further into the pad 12 and captured even more firmly as it rides under the capture area 164 between the ramp member 108 and the notch 168. Without interacting with either the notch 168 or the ramp member 108, the coin 206 continues under the ramp 170 and into the exit recess 172 where the pressure on the coin 206 is partially released so that the coin may be more easily moved radially outwardly and ejected by the guide edge 174.

FIG. 5 shows the sequential positions of a coin 208 which is larger than the selected coin size. As the coin 208 rides under ramp 102, it is fully captured by pad 12, but because its diameter is larger than the selected coin size, the outboard portion of the coin 208 rides under the inclined portion 160 of the ramp member 108. This tips the coin 208 upward along its inboard edge into a groove 166*a* extending along the edge 166. The coin is still captured by the pad 12, which rotates the coin in a radially fixed position toward the exit recess 172. The groove 166*a* (see FIGS. 13 and 14 accommodates the inboard edge of the coin 208 as it is tipped and helps guide the coin into the exit recess 172. As in the case of the smaller coins 206, the coin 208 rides under the releasing ramp 170 and into the exit recess 172 where the coin is moved outwardly and ejected by the guide edge.

Referring now to FIG. 3, a coin 104 having the same diameter as the referenced coin 190 is shown in sequential positions. As described above, the coin 104 is rotated under the ramp 102 and fully captured under the capture area 164 where the outboard edge of the coin 104 strikes and is reindexed by the probe tip 148. This moves the coin 104 slightly inboard so that the inboard edge of the coin 104 is urged into the notch 168, which in turn allows the pad 12 to capture the coin 104. The coin 104 is then rotated by the pad 12 past the ejection guide edge 174 along the lowermost surface of the guide plate 22 and toward the second exit recess 180. As long as a full count of coins has not been reached and the stop solenoid 196 is not energized, the coin 104 travels under the releasing ramp 182 into the exit recess 180 where the coin is moved outwardly and ejected by the guide edge 184.

When a full count of coins is reached, the stop shoe 188 is lowered to the position shown in phantom in FIG. 18, so that the coin 104' is not allowed to enter the exit recess 180. Instead, the coin 104' is rotated over the stop shoe 188, the guide edge 184, and toward a recycling recess 210. A beveled guide edge 212 in the recycling recess 210 guides coins inwardly toward the single file of coins forming against the edge 30 where they are merged to form a single file of coins moving toward the ramp 76. A strike plate 214 is mounted as shown to assist larger coins in their inward movement to prevent any stray coins from being inadvertently ejected from under the guide plate 22.

We claim:

1. A coin sorting apparatus for receiving and sorting mixed coins by denomination, said apparatus comprising:

a rotatable disc having a resilient surface for receiving said coins and imparting rotational movement to said coins;

a stationary disc having a contoured surface spaced slightly away from and generally parallel to said resilient surface of said rotatable disc, said stationary disc including a recess for guiding said coins on said rotatable disc into a single file of coins, and referencing means for guiding one edge of said coins in said single file along a first prescribed path having a known radial position;

means for simultaneously guiding coins of at least one selected denomination onto a second prescribed path having a known radial position that is offset from the radial position of said first prescribed path, and counting said coins of said selected denomination in response to guiding said coins of said selected denomination from said first prescribed path onto said second prescribed path;

means for discharging coins of different denominations at different circumferential locations around the periphery of said stationary disc, said circumferential locations being determined by said prescribed paths; and a movable diverter extending from the contoured surface of the stationary disc and located near the periphery of said stationary disc, the diverter responding to said means for simultaneously guiding and counting said coins by diverting coins of said at least one selected denomination from discharging at one of said different circumferential locations.

2. The coin sorting apparatus of claim 1 wherein said means for simultaneously guiding and counting said coins of said selected denomination comprises:

a probe for engaging an edge of said coins of said selected denomination, and moving said coins from said first prescribed path to said second prescribed path.

3. The coin sorting apparatus of claim 2 wherein said probe is spaced a preselected radial distance from said first prescribed path, said preselected radial distance determining the selected denomination of coin to be guided onto said second prescribed path.

4. The coin sorting apparatus of claim 2 wherein said means for simultaneously guiding and counting said coins of said selected denomination further comprises:

a counting circuit operably connected to said probe and adapted to count each of said coins engaged by said probe in response to said engagement.

5. The coin sorting apparatus of claim 1 wherein said movable diverter is activated in response to a prescribed number of coins being counted.

6. A coin sorting apparatus for receiving and sorting mixed coins by denomination, said apparatus comprising:

a rotatable disc having a resilient surface for receiving said coins and imparting rotational movement to said coins;

a stationary disc having a contoured surface spaced slightly away from and generally parallel to said resilient surface of said rotatable disc, said stationary disc including a recess for guiding the coins on said rotatable disc into a single file of coins, and means for referencing one edge of the coins and said single file along a first prescribed path having a first preselected radial position;

means for re-referencing coins of at least one selected denomination by moving said selected coins radially inwardly from said first prescribed path to a second prescribed path having a second prescribed radial position while said selected coins are being pressed between said guide plate and said disc so that said selected coins are rotated by said rotatable disc at said second preselected radial position, and for counting said selected coins in response to said re-referencing;

means for discharging coins of different denominations at different circumferential locations around the periphery of said stationary disc, said circumferential locations being determined by said prescribed radial locations of said coins; and a diverter extending from the contoured surface of the stationary disc and located near the periphery of said stationary disc, the diverter responding to said means for re-referencing and counting by diverting coins of said at least one selected denomination from discharging at one of said different circumferential locations.

7. The coin sorting apparatus of claim 6 wherein said means for re-referencing and counting said coins of said selected denomination comprises:

a probe for engaging an edge of said coins of said selected denomination, and moving said coins from said first prescribed path to said second prescribed path.

8. The coin sorting apparatus of claim 7 wherein said probe is spaced a preselected radial distance from said first prescribed path, said preselected radial distance determining the selected denomination of coin to be guided onto said second prescribed path.

9. The coin sorting apparatus of claim 7 wherein said means for re-referencing and counting said coins of said selected denomination further comprises:

a counting circuit operably connected to said probe and adapted to count each of said coins engaged by said probe in response to said engagement.

10. A coin sorting apparatus for receiving and sorting a mixture of coins by denomination, said apparatus comprising:

a rotatable disc having a resilient surface for receiving said coins and imparting rotational movement to said coins;

a stationary guide plate having a contoured surface which opposes said resilient surface of said rotatable disc, said guide plate including means for guiding said coins along a first prescribed path;

means for directing coins of at least one selected denomination onto a second prescribed path that is different from said first prescribed path, and for counting said coins of said at least one selected denomination in response to directing said coins of said at least one selected denomination from said first prescribed path onto said second prescribed path;

means, including a guiding edge formed in the contoured surface of the guide plate, for discharging coins of different denominations at different circumferential locations around the periphery of said guide plate; and a deflector located near the periphery of the guide plate, the deflector moving in response to said means for directing and counting by deflecting coins of said at least one selected denomination so that the deflected coins cross over the guiding edge of said means for discharging.

11. The coin sorting apparatus of claim 10 wherein said means for directing and counting said coins of said selected denomination comprises:

a probe for engaging an edge of said coins of said selected denomination, and moving said coins from said first prescribed path to said second prescribed path.

12. The coin sorting apparatus of claim 11 wherein said probe is spaced a preselected radial distance from said first prescribed path, said preselected radial distance determining the selected denomination of coin to be guided onto said second prescribed path.

13. The coin sorting apparatus of claim 10 wherein said probe directs said coins of said at least one selected denomination radially inwardly.

14. The coin sorting apparatus of claim 11 wherein said means for directing and counting said coins of said selected denomination further comprises:

a counting circuit operably connected to said probe and adapted to count each of said coins engaged by said probe in response to said engagement.

15. A coin sorting apparatus for receiving and sorting mixed coins by denomination, said apparatus comprising:

a rotatable disc having a resilient surface for receiving said coins and imparting rotational movement to said coins;

a stationary guide plate having a contoured surface spaced slightly away from and generally parallel to said resilient surface of said rotatable disc, said stationary guide plate including means for locating the innermost edges of said coins along a first prescribed path where the radially outer portions of said coins extend outwardly beyond the outer periphery of said rotatable disc while the radially inner portions of said coins are pressed into said resilient surface to hold the coins between said guide plate and said rotatable disc;

means for engaging said radially outer portions of at least one selected denomination of said coins, radially re-locating coins of said selected denomination with their innermost edges along a second prescribed path so that the innermost edges of coins of different denominations are located at different radial positions, and for counting coins of said selected denomination in response to engaging said radially outer portions of said coins of said selected denomination;

means for discharging coins of different denominations at different circumferential locations around the periphery of said guide plate, said circumferential locations being determined by the different radial locations of the coins; and a deflector located near the periphery of the guide plate, the deflector moving in response to said means for directing and counting by deflecting coins of said at least one selected denomination so that the deflected coins are not discharged.

16. The coin sorting apparatus of claim 15 wherein said coins of said at least one selected denomination are re-located by displacing those coins radially inwardly from said first prescribed path.

17. The coin sorting apparatus of claim 15 wherein said guide plate presses said coins of said selected denomination onto said resilient surface while said coins are being radially re-located.

18. The coin sorting apparatus of claim 15 wherein said engaging means comprises:

a probe operably connected to said guide plate to engage said coins of said selected denomination; and a counting circuit electrically connected to said probe and adapted to count each of said coins engaged by said probe in response to said engagement.

19. The coin sorting apparatus of claim 15 wherein said diverter is activated in response to a prescribed number of coins being counted.

20. A coin sorting apparatus for receiving and sorting mixed coins by denomination, said apparatus comprising:

a rotatable disc having a resilient surface for receiving said coins and imparting rotational movement to said coins;

a stationary guide plate having a contoured surface spaced slightly away from and generally parallel to said resilient surface of said rotatable disc, said stationary guide plate including means for locating the innermost edges of said coins at a first preselected radial position where the radially outer portions of said coins extend outwardly beyond the outer periphery of said guide plate while the radially inner portions of said coins are pressed into said resilient surface to hold the coins between said guide plate and said rotatable disc, said stationary guide plate further including an outwardly extending ramp member;

means for engaging said radially outer portions of at least one selected denomination of said coins, radially re-locating coins of said selected denomination with their innermost edges at a second preselected radial position so that the innermost edges of coins of different denominations are located at different radial positions, and counting coins of said selected denomination while said coins are under said ramp member, in response to engaging said radially outer portions of said coins of said selected denomination; and means for discharging coins of different denominations at different circumferential locations around the periphery of said guide plate, said circumferential locations being determined by the radial locations of the innermost edges of the coins.

21. The coin sorting apparatus of claim 20 wherein said coins of said selected denomination are re-located by displacing those coins radially inwardly from said first preselected radial position.

22. The coin sorting apparatus of claim 20 wherein said guide plate presses said coins of said selected denomination onto said resilient surface while said coins are being radially re-located.

23. The coin sorting apparatus of claim 20 wherein said engaging means comprises:

a probe operably connected to said guide plate to engage said coins of said selected denomination; and a counting circuit electrically connected to said probe and adapted to count each of said coins engaged by said probe in response to said engagement.

24. The coin sorting apparatus of claim 23 further comprising:

means for preventing coins from being discharged, said preventing means being activated in response to a prescribed number of coins being counted.

25. A coin sorting apparatus for sorting coins of mixed denominations, comprising:

a rotatable disc having a resilient surface for receiving said coins and imparting rotational movement to said coins;

a stationary guide plate having a contoured surface spaced slightly away from and generally parallel to said resilient surface of said rotatable disc;

means for positioning said coins of at least one coin denomination so that it is distinguishable from the other coin denominations while said coins are moved along a prescribed path between the rotatable disc and the stationary guide plate;

means for counting said coins of said at least one denomination as they are moved along said prescribed path;

means for sorting and discharging coins of different denominations at different locations around the periphery of said stationary guide plate; and means, responsive to said means for counting, for preventing coins of said at least one coin denomination from being sorted and counted.

26. A coin sorting apparatus, according to claim 25, wherein said means for sorting and discharging is responsive to said means for positioning said coins of at least one coin denomination, and wherein said stationary guide plate further includes an outwardly extending ramp member which is arranged to assist said positioning means in positioning said coins.

27. A coin sorting apparatus for sorting coins of mixed denominations, comprising:

a rotatable disc have a resilient surface for receiving said coins and imparting rotational movement to said coins;

a stationary guide plate having a contoured surface spaced slightly away from and generally parallel to said resilient surface of said rotatable disc;

a sensor affixed to said stationary guide plate over the rotatable disc;

said stationary guide plate including means for moving coins of at least one denomination along a prescribed path so that the sensor can sense the movement of coins of said at least one denomination between the stationary guide plate and the resilient pad;

means for sorting and discharging coins of different denominations at different circumferential locations around the periphery of said stationary guide plate; and means, responsive to said sensor, for preventing coins of said at least one coin denomination from being discharged at one of the different circumferential locations.

28. A method for sorting mixed coins by denomination in a coin sorting apparatus having a rotatable disc with a resilient surface for receiving said coins and imparting rotational movement to said coins and having a stationary guide plate with a contoured surface spaced slightly away from and generally parallel to said resilient surface of said rotatable disc, said method comprising the steps of:

counting said coins of at least one coin denomination, and positioning and sorting said coins of at least one coin denomination so that said coins of at least one coin denomination are distinguishable from the other coin denominations while said coins are moved along a prescribed path between the rotatable disc and the stationary guide plate;

discharging coins of different denominations at different locations around the periphery of said stationary guide plate;

providing a preselected number of coins of said at least one coin denomination to be counted; and in response to counting said preselected number of coins, preventing the discharge of additional coins of said at least one coin denomination.

29. A method for sorting mixed coins, according to claim 28, wherein the step of discharging coins of different denominations is in response to positioning said coins of said at least one coin denomination so that it is distinguishable from the other coin denominations.

30. A coin sorting apparatus for receiving and sorting mixed coins by denomination, said apparatus comprising:

a rotatable disc having a resilient surface for receiving said coins and imparting rotational movement to said coins;

a stationary disc having a contoured surface spaced slightly away from and generally parallel to said resilient surface of said rotatable disc, said stationary disc including a recess for guiding the coins on said rotatable disc into a single file of coins, and means for referencing one edge of the coins and said single file along a first prescribed path having a first preselected radial position;

means for re-referencing coins of at least one selected denomination by moving said selected coins radially inwardly from said first prescribed path to a second prescribed path having a second preselected radial position while said selected coins are being pressed between said guide plate and said disc so that said selected coins are rotated by said rotatable disc at said second preselected radial position, and for counting said selected coins in response to said re-referencing;

means for discharging coins of different denominations at different circumferential locations around the periphery of said stationary disc, said circumferential locations being determined by said preselected radial locations of said coins; and electrically actuated means, responsive to said means for re-referencing and counting, for preventing coins of said at least one selected denomination from being discharged.

31. The coin sorting apparatus of claim 30 wherein said means for re-referencing and counting said coins of said selected denomination comprises:

a probe for engaging an edge of said coins of said selected denomination, and moving said coins from said first prescribed path to said second prescribed path.

32. The coin sorting apparatus of claim 31 wherein said probe is spaced a preselected radial distance from said first prescribed path, said preselected radial distance determining the selected denomination of coin to be guided onto said second prescribed path, and wherein said stationary disc includes a ramp member which is arranged to assist said re-referencing means move said coins radially inwardly.

33. The coin sorting apparatus of claim 31 wherein said means for re-referencing and counting said coins of said selected denomination further comprises:

a counting circuit operably connected to said probe and adapted to count each of said coins engaged by said probe in response to said engagement.

34. The coin sorting apparatus of claim 30 wherein said electrically actuated means is actuated in response to a prescribed number of coins being counted.

35. A coin sorting apparatus for receiving and sorting a mixture of coins by denomination, said apparatus comprising:

a rotatable disc having a resilient surface for receiving said coins and imparting rotational movement to said coins;

a stationary guide plate having a contoured surface which opposes said resilient surface of said rotatable disc, said guide plate including means for guiding said coins along a first prescribed path;

means for simultaneously directing coins of at least one selected denomination onto a second prescribed path that is different from said first prescribed path, and for counting said coins of said at least one selected denomination in response to directing said coins of said at least one selected denomination from said first prescribed path onto said second prescribed path, wherein said means for simultaneously directing and counting said coins of said selected denomination includes a probe and a counting circuit operably connected to said probe and adapted to count each of said coins engaged by said probe in response to said engagement;

means for discharging coins of different denominations at different circumferential locations around the periphery of said guide plate; and means for preventing coins from being discharged in response to said directing and counting means counting a prescribed number of coins.

36. A coin sorting apparatus for receiving and sorting mixed coins by denomination, said apparatus comprising:

a rotatable disc having a resilient surface for receiving said coins and imparting rotational movement to said coins;

a stationary guide plate having a contoured surface spaced slightly away from and generally parallel to said resilient surface of said rotatable disc, said stationary guide plate including means for locating the innermost edges of said coins along a first prescribed path where the radially outer portions of said coins extend outwardly beyond the outer periphery of said rotatable disc while the radially inner portions of said coins are pressed into said resilient surface to hold the coins between said guide plate and said rotatable disc;

means for engaging said radially outer portions of at least one selected denomination of said coins, radially re-locating coins of said selected denomination with their innermost edges along a second preselected path so that the innermost edges of coins of different denominations are located at different radial positions, and for counting coins of said selected denomination in response to engaging said radially outer portions of said coins of said selected denomination;

means for discharging coins of different denominations at different circumferential locations around the periphery of said guide plate, said circumferential locations being determined by the different radial locations of the coins; and means, extending from the guide plate and disposed near the periphery of said guide plate, for preventing coins from being discharged in response to said directing and counting means counting a prescribed number of coins.

37. The coin sorting apparatus of claim 36 wherein said coins of said at least one selected denomination are re-located by displacing those coins radially inwardly from said first prescribed path.

38. The coin sorting apparatus of claim 36 wherein said guide plate presses said coins of said selected denomination onto said resilient surface while said coins are being radially re-located.

39. The coin sorting apparatus of claim 36 wherein said engaging means comprises:

a probe operably connected to said guide plate to engage said coins of said selected denomination; and a counting circuit electrically connected to said probe and adapted to count each of said coins engaged by said probe in response to said engagement.

40. The coin sorting apparatus of claim 36 wherein said means for preventing coins from being discharged is activated in response to a prescribed number of coins being counted.

41. A method of sorting coins having a diameter of a predetermined dimension from both coins having a diameter of less than said predetermined dimension and coins having a diameter of greater than said predetermined dimension in a disc-type coin sorter having a rotatable disc with a resilient surface for receiving said coins and imparting rotational movement to said coins, and a stationary sorting head having a contoured surface spaced slightly away from and generally parallel to said resilient surface of said rotatable disc, said sorting head forming a plurality of discharge stations spaced along the periphery of said head for selectively discharging coins according to the radial locations of the edges of the coins, said method comprising the steps of:

rotating said disc beneath said sorting head while feeding coins of mixed denominations between said disc and sorting head, arranging said coins in a single layer and in single file, and engaging the edges of said coins having a diameter of said predetermined dimension and said coins having a diameter greater than said predetermined dimension and displacing those coins so that coins having a diameter of said predetermined dimension and said coins having a diameter greater than said predetermined dimension are positioned to be discharged via different ones of said discharge stations, and providing an adjuster to set said predetermined dimension and change the coin denominations that are discharged at said discharge stations, whereby different combinations of coin denominations may be sorted and discharged at said discharge stations by altering said displacement.

42. The method of claim 41 wherein said discharge stations comprise exit channels formed in said sorting head, the edges of said exit channels being radially offset from each other for receiving coins having their corresponding edges located at different circumferential positions, and wherein said step of engaging and displacing said coins having a diameter equal to said predetermined diameter and said coins having a diameter greater than said predetermined dimension causes said coins having a diameter less than said predetermined dimension to be discharged from the discharge station having the exit channel with an outermost circumferential position.

43. The method of claim 41 wherein the inner edges of said coins are aligned along said common path by pressing said coins into said resilient surface while moving said coins circumferentially along an outwardly spiralling guide wall formed in said sorting head.

44. The method of claim 41 wherein coins having a diameter not less than said predetermined dimension are engaged by a deflector having an adjustable guide surface on said sorting head.

45. A stationary guide plate for use with a rotatable-disc coin-sorting system for receiving coins and imparting rotational movement to said coins, the stationary guide plate comprising:

a contoured surface including a guiding recess against which said coins placed therein form a first prescribed path;

means for simultaneously engaging and sensing a coin of at least one selected denomination such that in response to said coin being engaged and sensed said coin crosses onto a second prescribed path that is different from said first prescribed path; and a plurality of discharge recesses constructed and arranged to fit coins of different denominations and located at different circumferential locations around the periphery of said guide plate.

46. A stationary disc for use with a rotatable-disc coin-sorting system for receiving coins and imparting rotational movement to said coins, the stationary disc comprising:

a contoured surface including a recess against which said coins placed therein form a single file of coins, and a coin-edge surface against which one edge of the coins engaged engaged by said coin-edge surface form said single file along a first prescribed path having a first preselected radial position;

at least one engagement surface constructed and arranged such that said coins engaged thereby cross radially inwardly from said first prescribed path to a second prescribed path having a second preselected radial position, and including means for sensing electrically said selected coins in engagement with said at least on engagement surface; and a plurality of exit regions constructed and arranged to position coins of different denominations at different circumferential locations around the periphery of said stationary disc, said circumferential locations being determined by said different denominations.

* * * * *